US009021617B2

(12) United States Patent
Asta

(10) Patent No.: US 9,021,617 B2
(45) **Date of Patent: *May 5, 2015**

(54) PROTECTION DEVICE, SYSTEM AND/OR METHOD

(75) Inventor: John Asta, Steamboat Springs, CO (US)

(73) Assignee: Astar Listings, LLC, Steamboat Springs, CO (US)

( * ) Notice: Subject to any disclaimer, the term of this patent is extended or adjusted under 35 U.S.C. 154(b) by 285 days.

This patent is subject to a terminal disclaimer.

(21) Appl. No.: 13/467,844

(22) Filed: May 9, 2012

(65) Prior Publication Data

US 2012/0216340 A1 Aug. 30, 2012

Related U.S. Application Data

(63) Continuation-in-part of application No. 12/611,013, filed on Nov. 2, 2009, now Pat. No. 8,201,276.

(60) Provisional application No. 61/110,465, filed on Oct. 31, 2008.

(51) Int. Cl.
*A42B 1/24* (2006.01)
*A42B 3/10* (2006.01)

(52) U.S. Cl.
CPC ..... *A42B 3/105* (2013.01)

(58) Field of Classification Search
CPC ..... A42B 3/105
USPC ..... 2/206, 207, 422, 424, 9, 209.13, 174, 2/6.2, 4, 6.6, 468, 455, 466; D29/100, D29/101.2, 103
See application file for complete search history.

(56) References Cited

U.S. PATENT DOCUMENTS

| | | | |
|---|---|---|---|
| 3,825,952 | A | 7/1974 | Pershing et al. |
| D239,218 | S | 3/1976 | Fortson |
| 4,017,906 | A | 4/1977 | Bochynsky et al. |
| 4,031,567 | A | 6/1977 | Planck |
| 4,042,976 | A | 8/1977 | Reynolds |
| 5,381,559 | A | 1/1995 | Wakefield, III |
| 5,608,914 | A | 3/1997 | Keesler |
| 5,694,647 | A | 12/1997 | Crickmore |
| 5,867,833 | A | 2/1999 | LeDonne |
| 5,906,006 | A | 5/1999 | Castro, Jr. |
| 5,974,634 | A | 11/1999 | Eisenpresser |
| 6,029,278 | A | 2/2000 | Lopez |
| 6,047,401 | A | 4/2000 | Traumer |
| 6,263,512 | B1 | 7/2001 | LeDonne |
| 6,282,721 | B1 | 9/2001 | Travalgia |
| 6,295,652 | B1 | 10/2001 | Mazur |
| D476,133 | S | 6/2003 | Weidenhaupt |
| 6,862,749 | B1 | 3/2005 | Krause |

(Continued)

FOREIGN PATENT DOCUMENTS

WO WO 02074116 A2 9/2002

*Primary Examiner* — Khoa Huynh
*Assistant Examiner* — Anna Kinsaul
(74) *Attorney, Agent, or Firm* — Merchant & Gould P.C.

(57) ABSTRACT

A protection device, system and/or method including a protection body portion adapted to be one or both of connected to or disposed on the lower edge of a wearer's headgear. In some implementations, the protection body portion may be triangular and the connecting of the device to headgear may include a removable connective component is located at the apex of a second edge and a third edge of the protection body portion at the farthest point from the headgear.

18 Claims, 13 Drawing Sheets

(56) References Cited

U.S. PATENT DOCUMENTS

| | | | | |
|---|---|---|---|---|
| 6,978,487 | B2 | | 12/2005 | Abraham |
| 7,082,620 | B1 | | 8/2006 | Rongione |
| 200/60253957 | | * | 11/2006 | Orozco ..... 2/171 |
| D595,013 | S | | 6/2009 | Fuentes |
| 8,201,276 | B2 | | 6/2012 | Asta |
| 8,555,418 | B2 | * | 10/2013 | Singh et al. ..... 2/173 |
| 2005/0229291 | A1 | | 10/2005 | Gendall |
| 2007/0157369 | A1 | | 7/2007 | Uchibori et al. |
| 2008/0022432 | A1 | * | 1/2008 | Clague ..... 2/98 |

* cited by examiner

PROTECTION DEVICE, SYSTEM AND/OR METHOD

CROSS-REFERENCE TO RELATED APPLICATIONS

This application is a continuation-in-part application of U.S. patent application Ser. No. 12/611,013 (now U.S. Pat. No. 8,201,276, issued Jun. 19, 2012), entitled "PROTECTION DEVICE, SYSTEM AND/OR METHOD," filed on Nov. 2, 2009, which claims the benefit of priority under 35 U.S.C. §119(e) from U.S. Provisional Patent Application No. 61/110,465, entitled "PROTECTION DEVICE, SYSTEM AND/OR METHOD," filed on Oct. 31, 2008, which applications are incorporated herein in their entirety by this reference.

BACKGROUND

The present developments are directed generally to a protection device or system or method and more particularly in some implementations to a protection device for face, neck, and upper torso, but more particularly to such a device that may typically be used for activities that involve exposure of the wearer to adverse elements, and that also include use of headgear or a helmet.

Protection in some senses has been available from bandanas or like cloth devices which have generally been used in some implementations to cover the face or neck of a wearer. As such, bandanas have been used for various purposes. Such bandanas have generally been of dimensions sufficient to cover the head or face or neck of a wearer. They can protect the wearer's face or neck or head or clothing from the elements such as dirt, snow, ice, rain, smoke, emissions, or bugs, for example. Bandanas have been made of cloth or other similarly flexible material, and may be tied on or adjusted in a variety of ways to effect the described functionalities.

SUMMARY

Herein described are protection devices, systems, and/or methods by which the protection devices may be used. Namely, the developments hereof concern a protection device that may be adapted to attach to a helmet or other type of head gear and cover the face, neck and upper torso of the wearer.

The present developments may provide protection from the elements and from conditions such as frostbite, frozen clothing, smoke, windburn, inhalation of bugs and/or emissions, and inhalation of smoke and dirt, while in many implementations allowing some distance or air space between the user's face and/or neck and the elements. The subject protection devices may be secured to the wearer's headgear and positioned around the wearer's face, neck, and at least a portion of the upper torso to protect against such elements. A bottom portion of the protection device may in some implementations also be removably attached to the apparel of the wearer to further secure its position in place on the upper torso of a wearer.

DETAILED DESCRIPTION

Figure 1A:
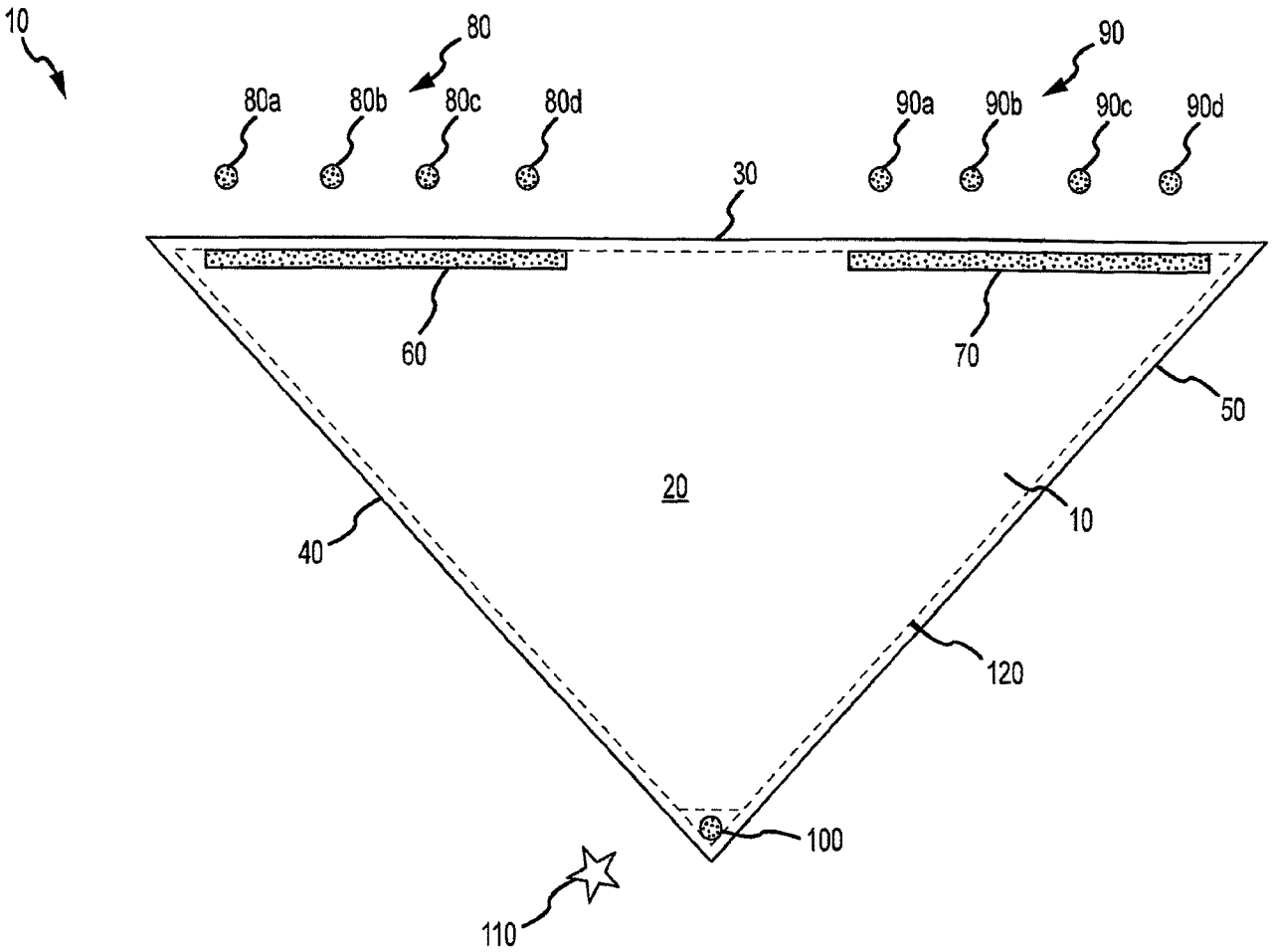
FIG. 1, which includes sub-part FIGS. 1A, 1B, 1C, and 1D, provides a plan view of a protection device hereof.

The developments hereof relate to face, neck, and upper torso protection devices, systems and/or methods, such typically being adapted to enable protection and coverage of a wearer's face, neck, and at least a portion of a wearer's upper torso, and/or a system and/or method of use thereof. The developments hereof relate to a protection or potential bandana-type device adapted to be secured to headgear of a wearer. Such a device may be adapted also to be secured to the apparel of the wearer or reinforced to protect at least a portion of the wearer's upper torso. In some implementations hereof the protection device will be removable, and in some cases, a triangular shaped or otherwise substantially triangular or tapered device; in any case, such a tapering or like-shaping can, inter alia, add to or provide for apparel connectivity at the upper or mid torso, and/or for ventilation (described further below). Note, rectangular or other shapes may also be used, and may also provide a ventilation aspect as below. In many implementations, the devices hereof will preferably be made of waterproof or water resistant material and in some cases be adapted to allow fresh air flow and ventilation to the wearer, and/or alternatively provide for a quick release safety connection system which can, inter alia, can be released in the event of any shortness of breath by wearer. The device may also/alternatively be made relatively stiff, typically at the substantial vertical edges, with a medium such as wire or other stiffening component so as to remain in position relative to the user's face, neck and/or upper torso.

As generally shown in FIG. 1, an implementation of a protection device 10, as such may typically be used to cover the face, neck, and at least a portion of the upper torso of a wearer, may be a device 10 not unlike a bandana in some implementations (as it may in some implementations be so referred to generally herein, though is not limited thereto). Such a protection device may have a body portion 20. As shown here, the body portion 20 may have a generally triangular shape. Note, triangular or substantially triangular or otherwise tapered as in reduced or reducing width from the helmet downward frontally, can contribute to or further provide for either or both of apparel connectivity or ventilation as described below; however, non-triangular or non-tapering alternatives may also be available, as a rectangular device wherein the device is connected at the front, but, not wrapping around a user to allow back and/or side ventilation options, i.e., the shape may not necessarily be triangular or the like, but may yet in many applications preferably be such that it does not wrap completely around the user's headgear, or does not wrap fully around the user's body, whether neck and/or upper torso, and thus may leave a back side (either or both sides) relatively open so it may provide an open space for optional air flow and/or ventilation from those side(s). Preferably in many alternatives, the design/shape hereof, whether triangular, substantially triangular or otherwise; e.g., polygonal, semi-circular, or otherwise with in some cases a reduced width below relative to a wider base adjacent the helmet (i.e., at least partially tapered), or simply not reduced, but not wrapped around the user, can allow for fresh air flow and ventilation for wearer aiding in breathability and reduction of $CO_2$ emissions as well as minimizing any fogging to wearers goggles or helmet visor and also allows for coverage of the upper portion of a wearer's clothing which can be beneficial in freezing conditions to keep clothing zippers from freezing shut, inter alia. The body portion 20 may be made of any suitably protective material, such as, for example, nylon, rip stop material, water-resistant material, waterproof material, wind-resistant material, mesh, cotton, fur, or the like. Other materials can be used as well, e.g., breathable materials. According to embodiments, the suitable protective material may comprise an inherent weight adapted to suspend a depending tapering portion of the protection device in a substantial to full downward extension toward the wearer's apparel as a result of the inherent weight of the body portion (illustrated by FIGS. 1D and 7C). According to some embodiments, the inherent weight of the body portion may be attributable to the suitable protective material itself (i.e., a thick, tightly woven, or otherwise dense or heavy-weight material). Alternatively, the inherent weight of the body portion may be attributable to a length of the body portion. That is, the suitable protective material may be made of a light-weight material but may suspend the protection device in a substantial downward extension as a result of a length of the depending tapering portion. According to other embodiments, the suitable protective material may comprise properties such as rigidity for causing a depending tapering portion of the protection device to be suspended in a substantial to full downward extension toward the wearer's apparel or the wearer's upper torso.

The first edge 30 of a protection device 10 which in the version of FIG. 1 is substantially triangle-shaped, would typically be adapted to be affixed to a wearer's headgear, such as a helmet, not shown in FIG. 1. The second edge 40 and the third edge 50 of the protection device 10 would typically be of generally similar dimensions one to another, often equal or substantially equal to one another. As introduced, the device 10 may be adapted to one or both of connected or disposed on or near the lower edge of headgear such as a helmet (as shown, for example, in FIGS. 2-6 described further below). One manner of achieving this may include detachable attachment devices or means. In the example of FIG. 1, the first edge 30 of the protection device 10 may have one component 60 of a two-part press-together connection assemblage 60/80 on the side of the protection device 10 that may face the wearer, not shown in FIG. 1. There may be one such first component 60 (as illustrated in FIG. 7) or more than one such first component 60 and 70 (as illustrated in FIG. 1). Complementary to each of the one or more first components 60, 70 of respective two-part press-together connection assemblages may be the second components 80 and 90, component 80 with component 60 and component 90 with component 70. These second components 80 and 90 of the two-part press-together connection assemblages are illustrated here as or formed by exemplar sub-parts 80*a*, 80*b*, 80*c*, and 80*d*, and by sub-parts 90*a*, 90*b*, 90*c*, and 90*d*. The components 60, 70, 80, and 90 may be any suitably connective materials, such as, for example, hook and loop fasteners, closures, snaps, hooks, buttons, tape, reusable sticky-back material, snap fasteners, pins, or like or not like parts/materials. Preferably, the connection will allow wearer to remove the device 10 easily and quickly by grabbing the second edge 40 or the third edge 50 and simply tugging at it to remove it from the connection components.

Figure 1B:
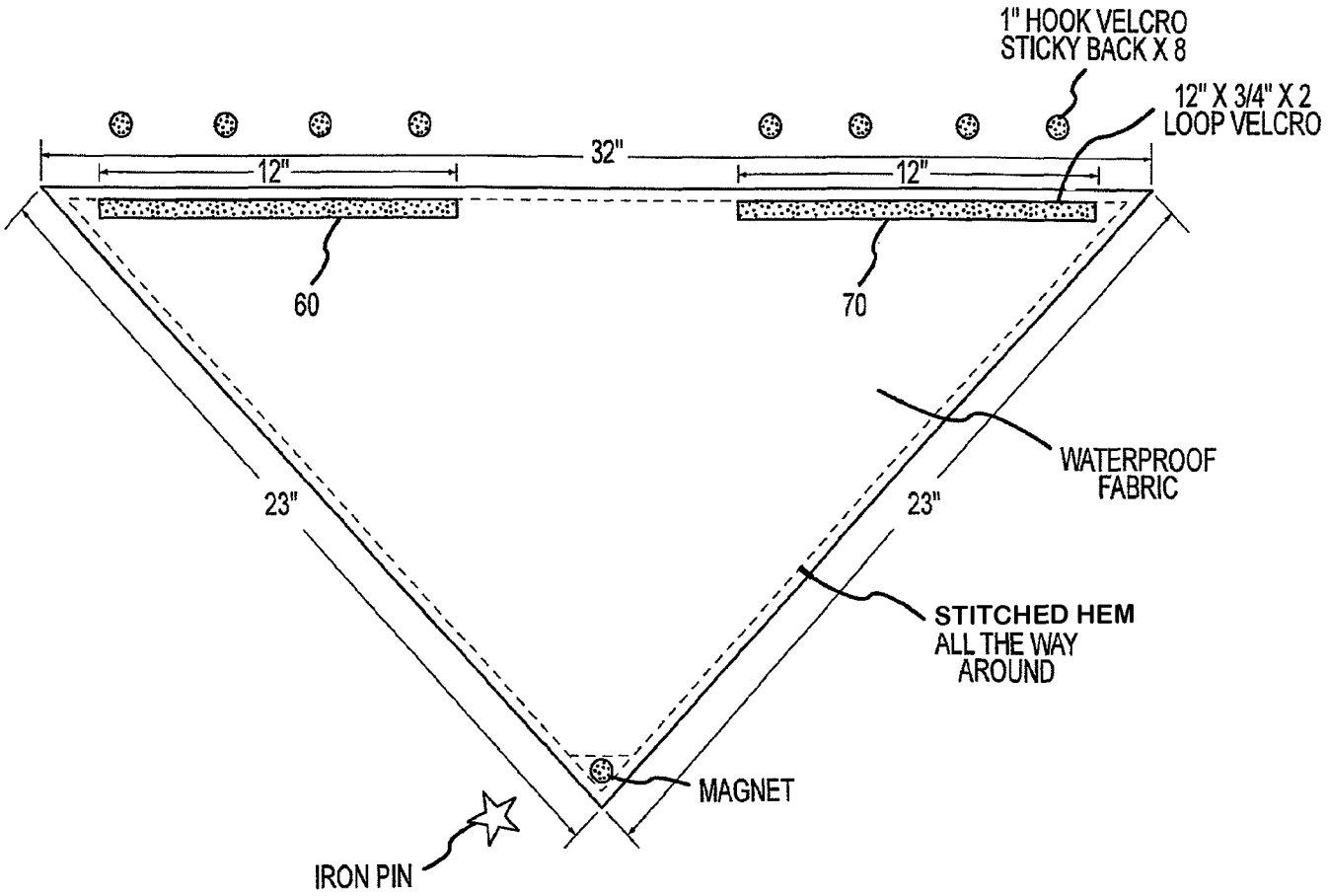
Figure 7A:
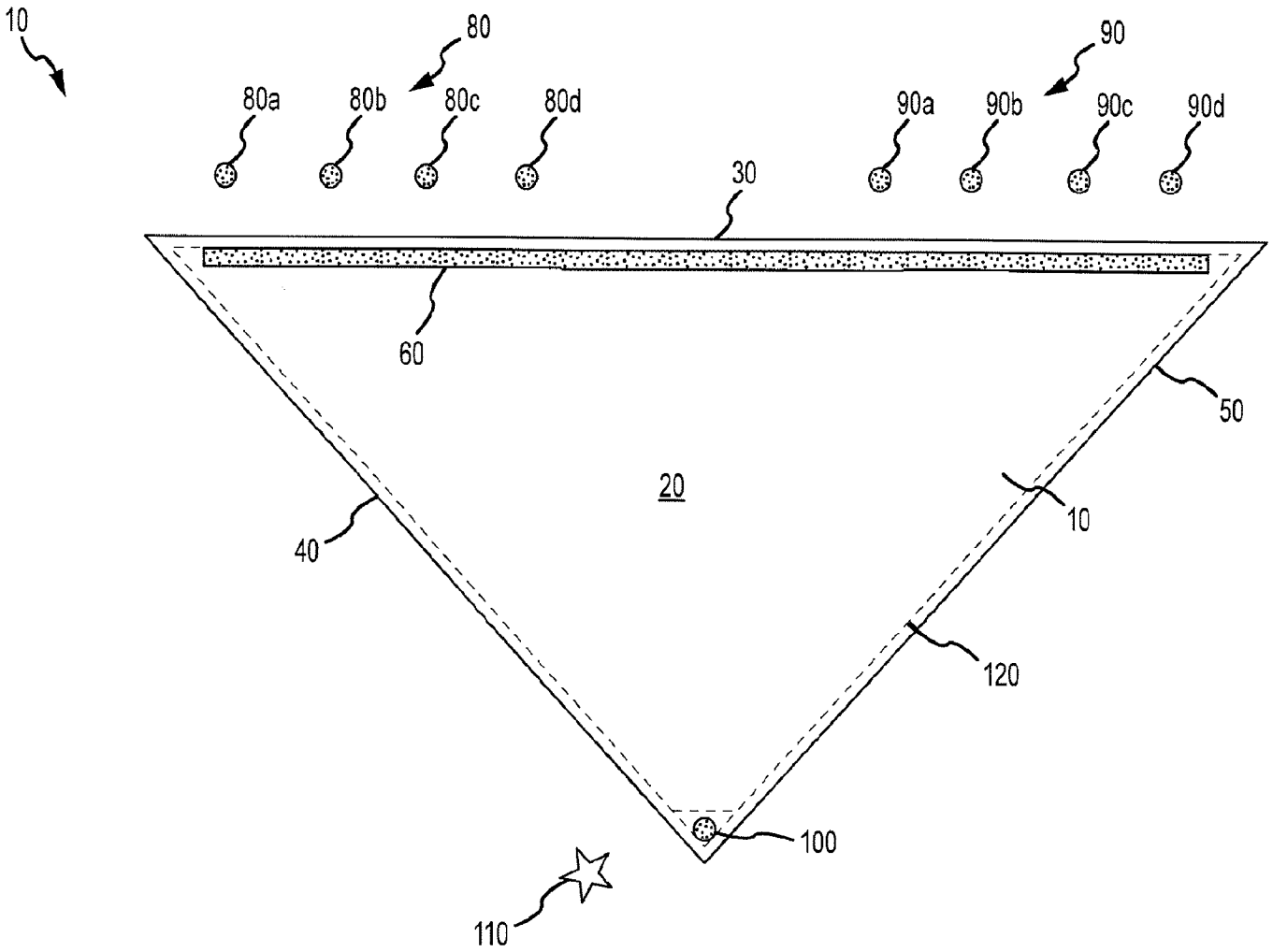
FIG. 7, which includes sub-part FIGS. 7A, 7B and 7C, provides an embodiment of a protection device having one continuous connection element.

The protection device 10 may also have a connection component 100 disposed at or approximately near the meeting point of edges 40 and 50 (as illustrated by FIGS. 1A-B and 7A). The connection component 100 may be affixed or removably attached to the protection device 10 via any suitable means. For example, the connection component 100 may be sewn on or into the material, may be glued, may be affixed through the material, may be removably affixed onto the material with hook and loop fasteners, snaps, clips, pins, etc. According to one embodiment, the connection component 100 may be adapted to be coupled with a complementary connection component 110, which could be fixedly or removably attached to the wearer's apparel (as illustrated by FIGS. 1A-B and 7A, the wearer not being shown). According to embodiments, the connection component 100 may comprise an inherent weight causing the protection device to be disposed downward and toward or against the wearer's upper torso or apparel by virtue of the operation of gravity on the connection component 100 when in a non-connected state. For example, the connection component 100 may be adapted to suspend a depending tapering portion of the protection device in a substantial to full downward extension toward the wearer's upper torso or apparel as a result of the inherent weight of the connection component 100. Of course, when in a connected state, the protection device will be deposed in a substantially downward position by virtue of the connection. The connection component 100 may be or may provide a one handed quick release safety connection, while at the same time providing a quick release safety system where the device may be removed by wearer quickly with just one hand in case of any shortness of breath.

Figure 1C:
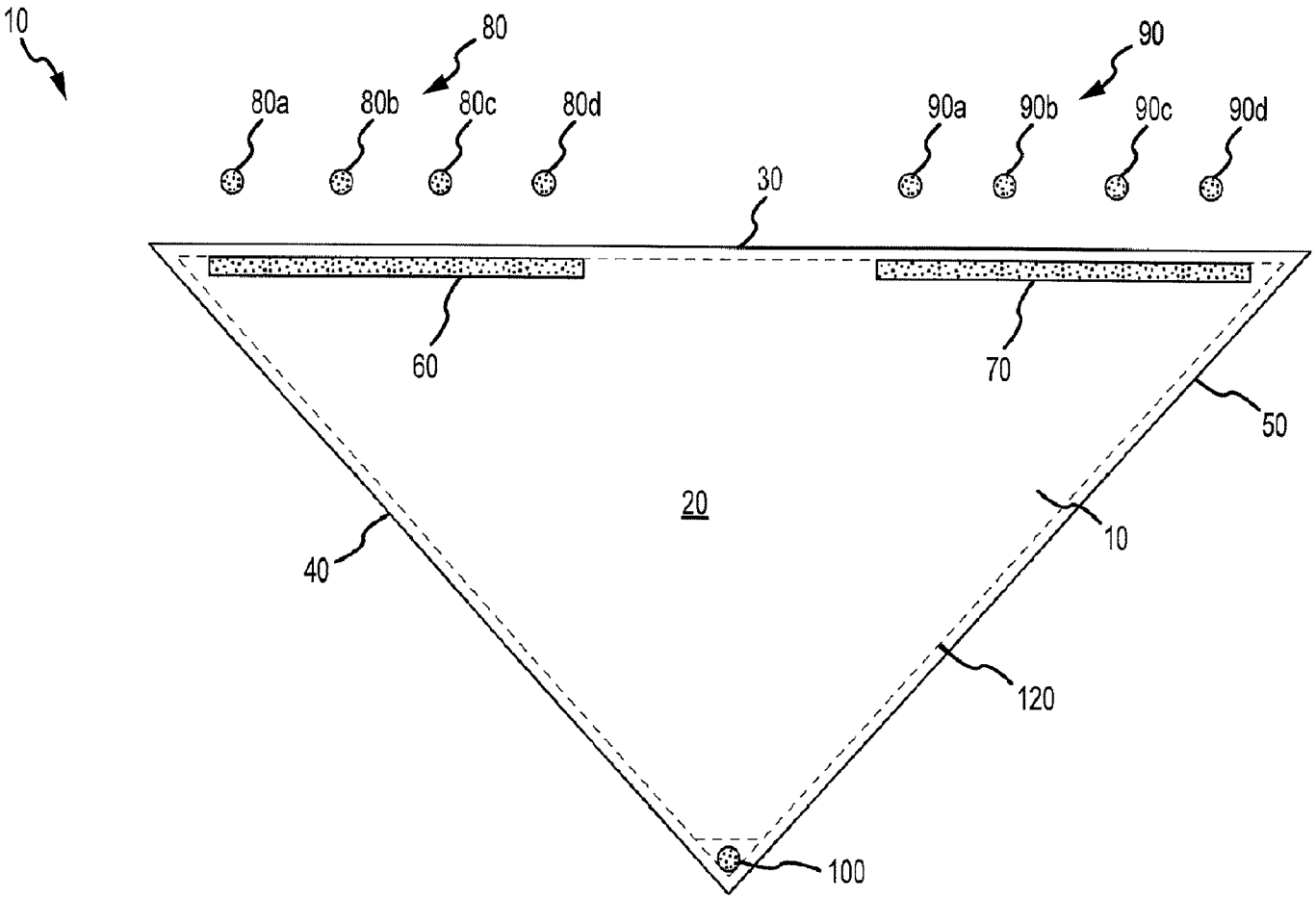
Figure 1D:
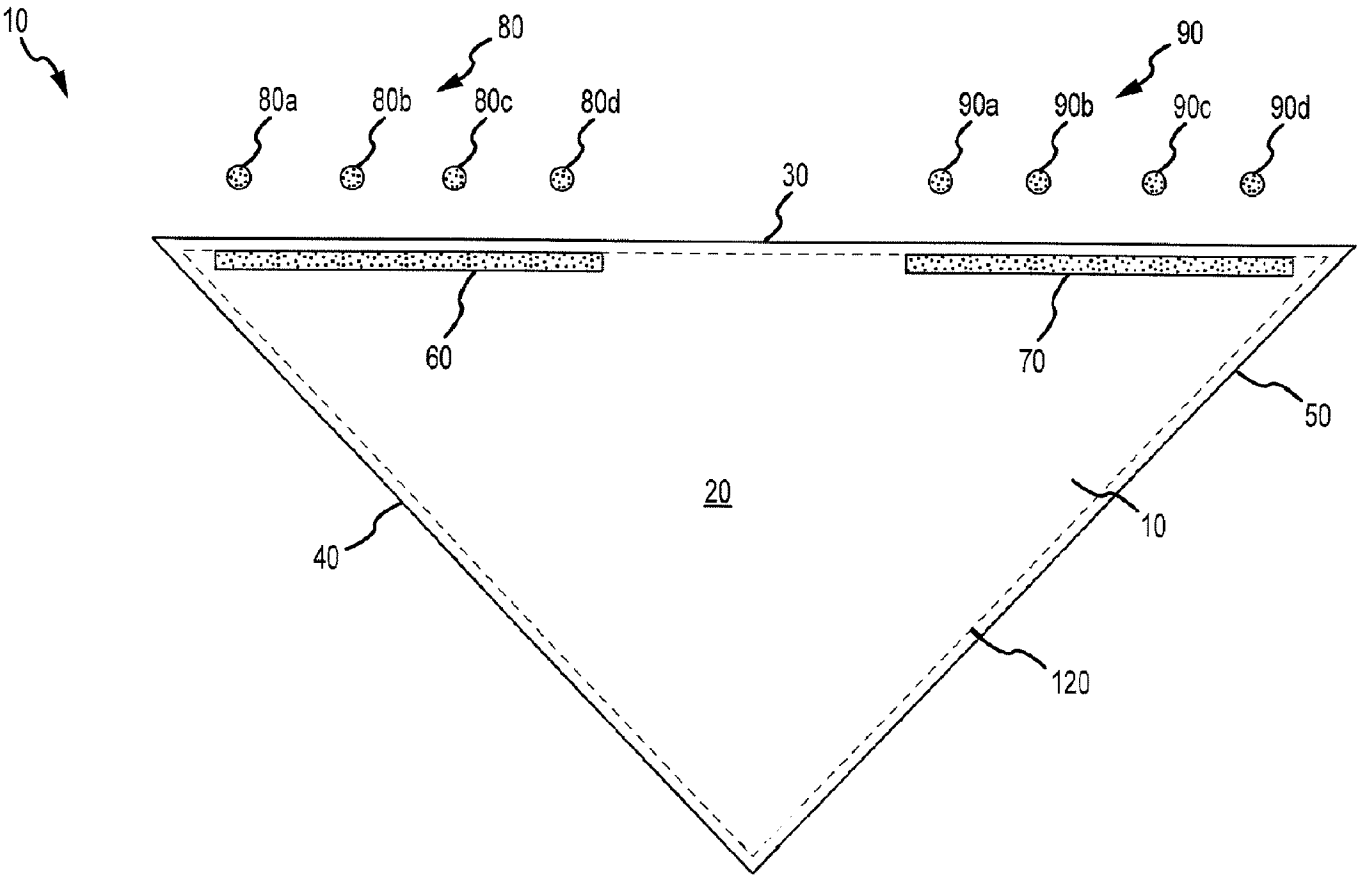
Figures 3A, 3B:
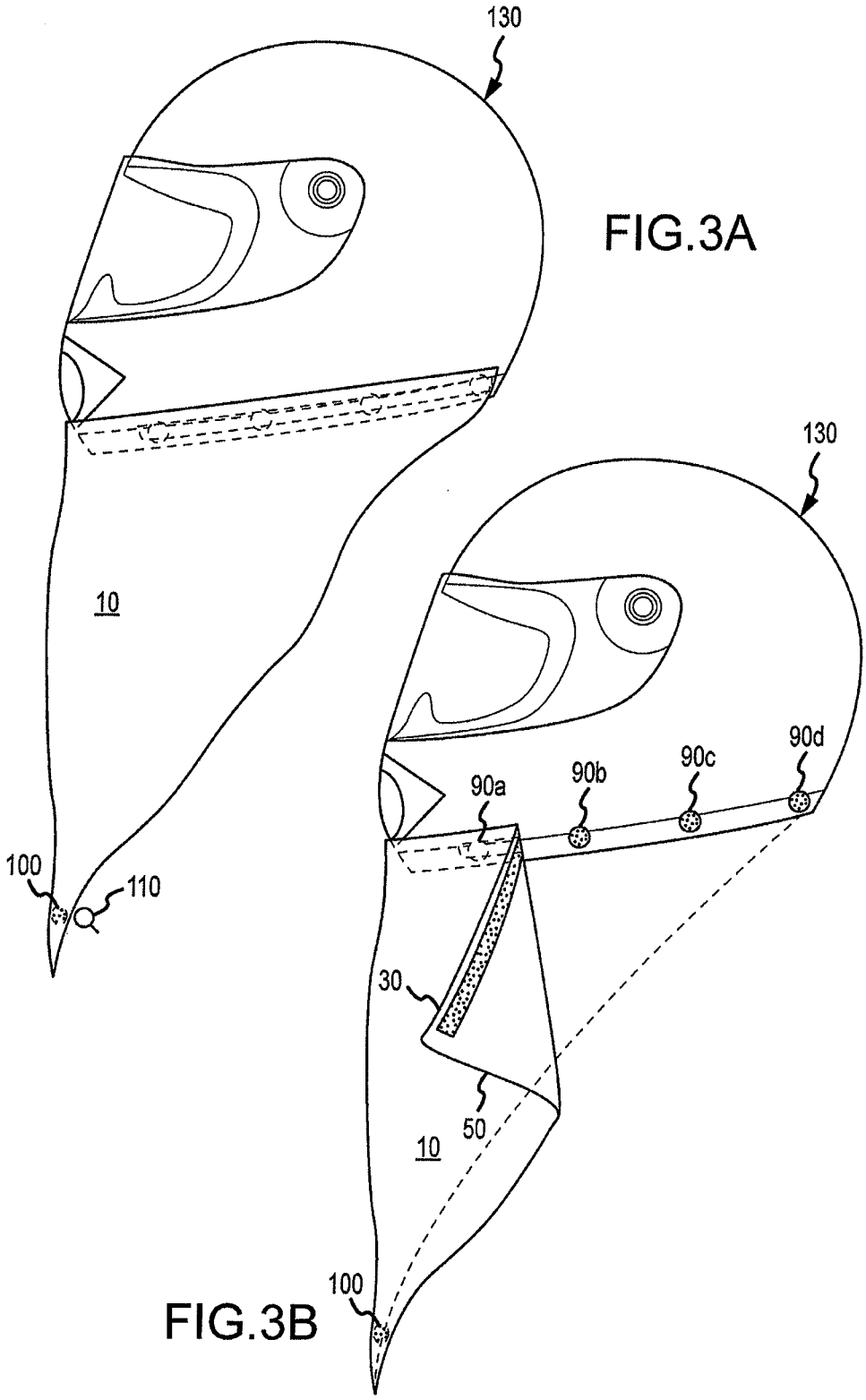
FIG. 3, which includes sub-part FIGS. 3A, 3B and 3C, provides another isometric view of a protection device as assembled together with a helmet.
Figure 7B:
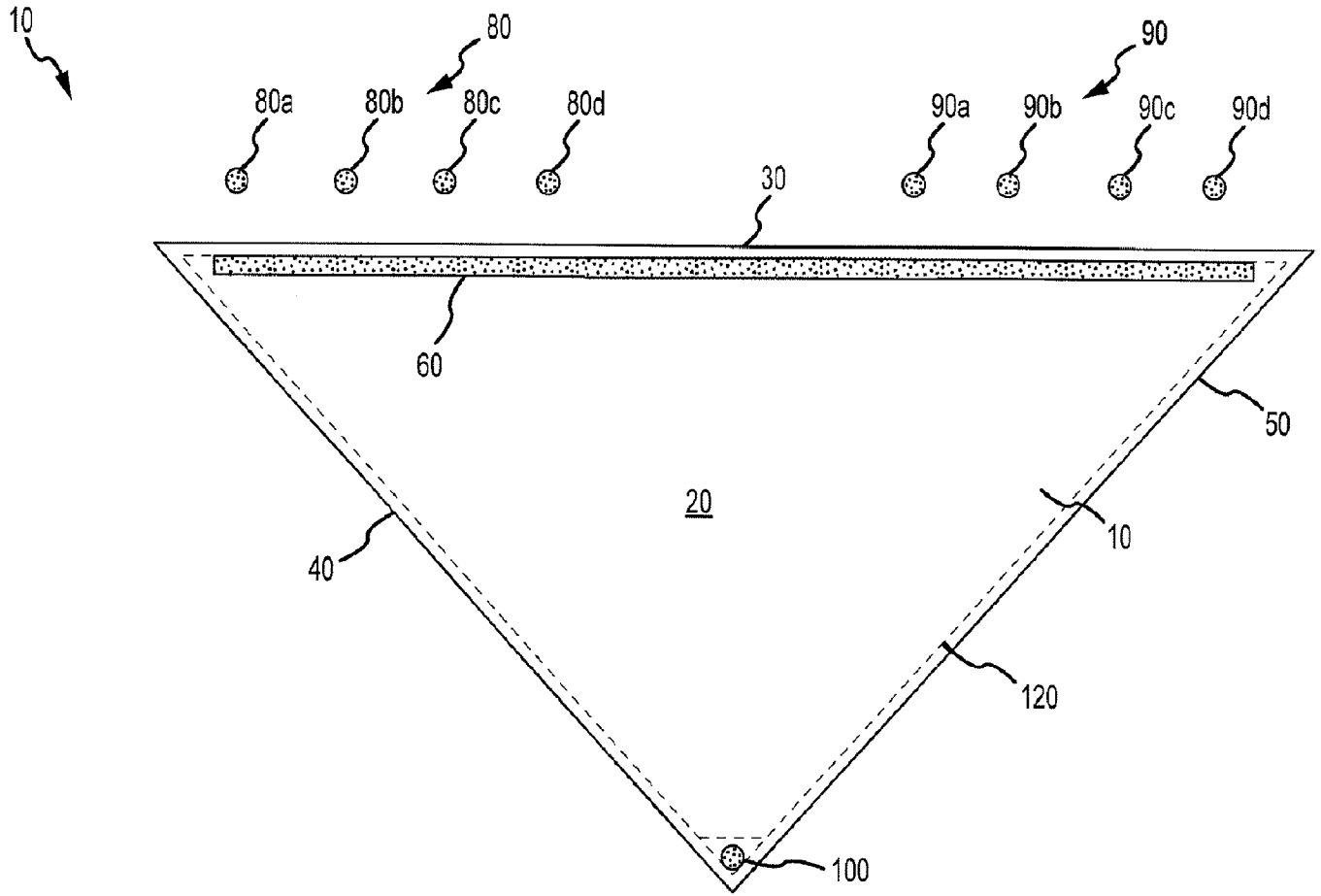

According to an alternative embodiment, the protection device 10 may have a weighted element 100 disposed at or approximately near the meeting point of edges 40 and 50 (as illustrated by FIGS. 1C and 7B). The weighted element 100 may be affixed or removably attached to the protection device 10 via any suitable means. For example, the weighted element 100 may be sewn on or into the material, may be glued onto the material, may be affixed through the material, may be removably affixed onto the material with hook and loop fasteners, snaps, clips, pins, etc. According to other embodiments, the weighted element 100 may be disposed along edges 40 and 50 such that the weighted element 100 is not concentrated at the meeting point of edges 40 and 50 but is distributed over at least a portion, such as the depending tapering portion, of the protection device 10. The weighted element 100 may be adapted to suspend a depending tapering portion of the protection device 10 in a substantial to full downward extension toward the wearer's upper torso (as illustrated by FIGS. 1C, 3B, and 7B, the wearer not being shown). According to embodiments, the weighted element 100 may be of any suitable weight such that the weighted element 100 is adapted to cause the protection device to be disposed downward and toward or against the wearer's upper torso or apparel by virtue of the operation of gravity on the weighted element 100. According to further embodiments, the weighted element 100 may prevent the protection device from being displaced from a substantially downward extension by wind, by the wearer's movements, etc. As such, the weighted element 100 may thereby prevent the protection device from obstructing the wearer's vision or the wearer's range of movement by maintaining the protection device in the substantially downward extension. According to embodiments, the weighted element 100 may have any suitable weight. For example, the weighted element 100 may be made of any suitable weighted material, e.g., any type of metal or metal alloy, any type of plastic or other synthetic material, any type of glass, any composite of materials, etc. According to embodiments, the weighted element 100 may or may not be adapted to be connectable. For example, the weighted element 100 may be a connection component, e.g., a magnet, adapted to be coupled with a complementary connection component, e.g., complementary connection component 110 (as illustrated by FIGS. 1A-B and 7A).

The protection device 10 may also have stitching 120 along each of its edges 30, 40, and 50, to prevent fraying or other wear and tear. Alternatively, the protection device 10 may have a wire or wiring or other reinforcement-type material along one or more of its edges 40 and 50, to stiffen and stabilize the protection device 10 to remain in position over a portion of the front portion of a wearer's upper torso. According to some embodiments, the wire or other reinforcement-type material may have an inherent weight so as to suspend a depending tapering portion of the protection device in a substantial to full downward extension toward the wearer's upper torso or apparel as a result of the inherent weight. According to other embodiments, the wire or reinforcement-type material may be adapted to suspend a depending tapering portion of the protection device in a substantial to full downward extension toward the wearer's upper torso as a result of reinforcement properties of the wire or reinforcement-type material.

Figure 2:
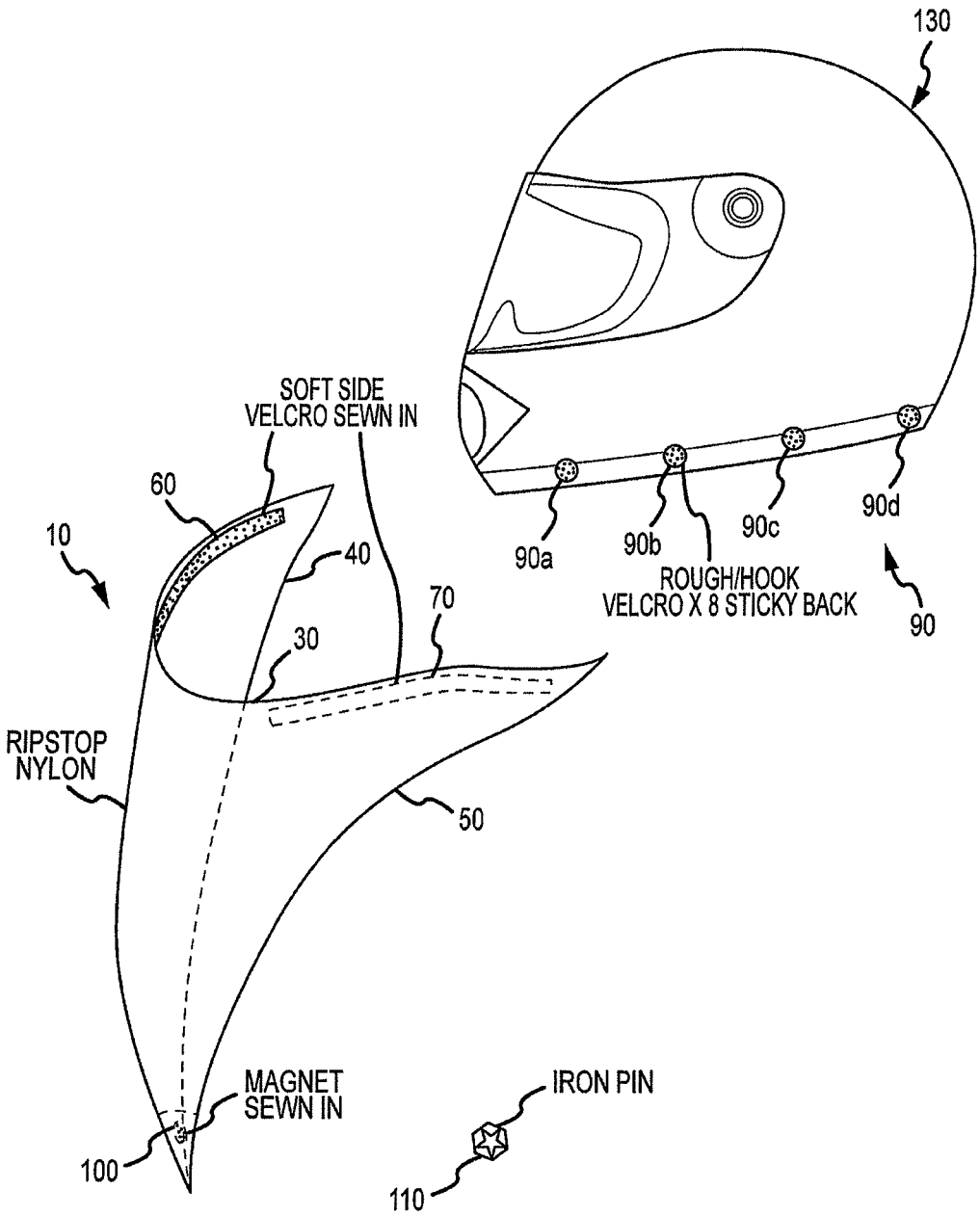
FIG. 2 provides an isometric view of a protection device hereof and an elevational view of helmet headgear which may be used therewith.

FIG. 2 depicts a protection device 10 hereof in use with particular headgear 130; here, a full-face helmet which may or may not include a lens visor, with which the device 10 may be adapted to operate. The device 10 is shown oriented in such a way as to be positioned to be attached to the helmet 130. The first edge 30 of the protection device 10 is positioned so as to be coupled with the lower edge 140 of the helmet 130. The second edge 40 and the third edge 50 extend downwardly away from the helmet and away from the face of the wearer. The press-together first connection components 60, 70 are shown along the first edge 30 of the protection device 10. The first components 60, 70 of the two-part press-together connection may be aligned and coupled with the respective second components 80 and 90 of the two-part press-together connection, illustrated here sub-parts 90*a*, 90*b*, 90*c*, and 90*d*. Preferably, the connection will allow wearer to remove the device easily and quickly by grabbing the second edge 40 or the third edge 50 and simply tugging at it to remove it from the connection components.

The connection component 100, if implemented, may be located at or near the apex of second edge 40 and third edge 50. The position of the connection component 100 may be such that it may serve to removably connect the protection device 10 to the apparel of the wearer, shown in FIG. 3C (described further below), by in some examples coupling with a complementary connection component 110. The complementary connection component 110 may be positioned on the apparel of the wearer in such a manner as to allow for substantially full extension of the protection device 10, allowing simultaneously for coverage of a portion of the upper torso, and the front part of the neck and face of the wearer. Preferably, a connection between the connection component 100 and the complementary connection component 110 will allow for sufficient freedom of movement of the wearer as well as a quick release safety system allowing wearer to quickly remove the protection device away from mouth in the event of any shortness of breath.

Figure 3C:
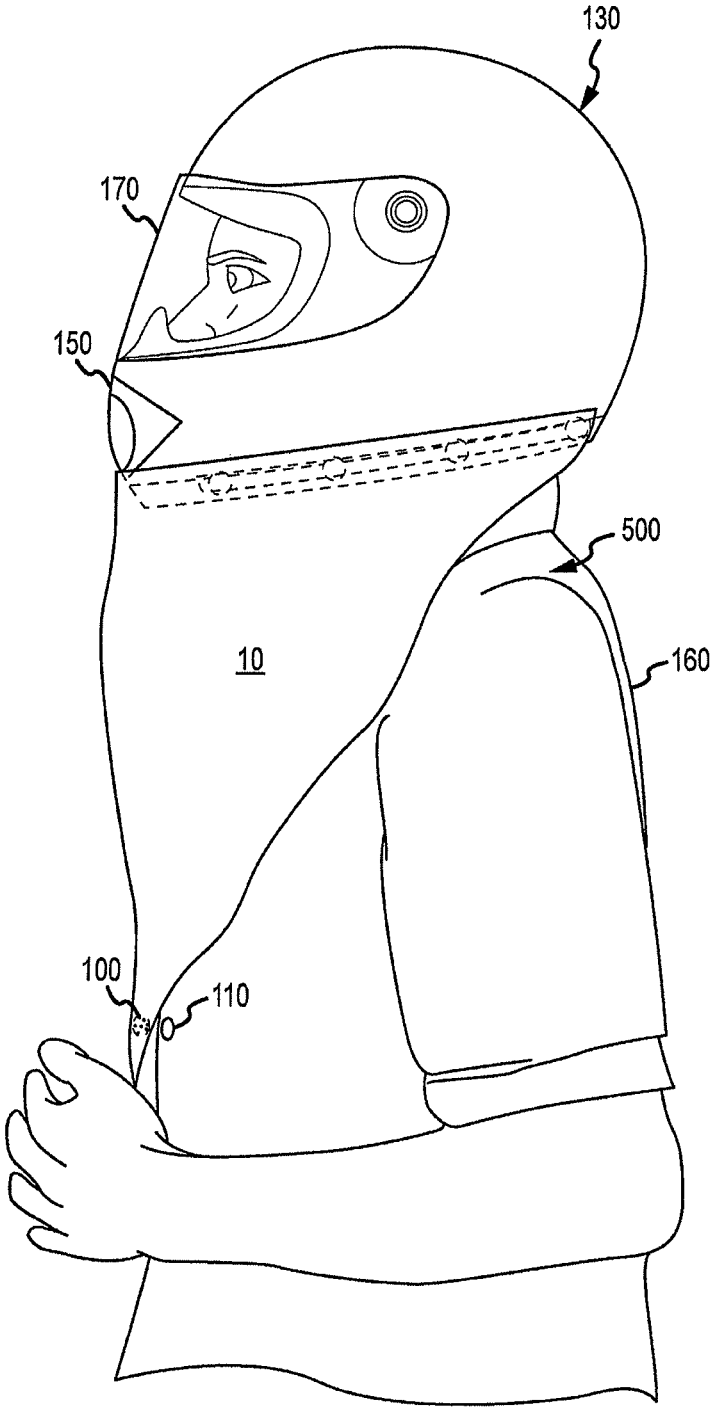

FIG. 3 illustrates the protection device 10 in use; particularly here being used to cover the neck and face and a portion of the upper torso of a helmet wearer. In FIG. 3A, the protection device 10 is coupled with the helmet 130 and attached to the apparel 160 of the wearer 500 (apparel and wearer shown in FIG. 3C, described further below) by way of the connection component 100 and complementary connection component 110. Note that the position and shape/design of the protection device 10 when coupled with the helmet 130 may still allow for the wearer to breathe through the helmet through aperture 150 and to see through aperture 170. As illustrated in FIG. 3C, the protection device 10 may be employed in such a manner as to achieve sufficient extension of the protection device 10 across the front of the apparel 160 of the wearer and thereby substantially cover the wearer's face and neck and at least a portion of or a part of the upper torso.

In FIG. 3B, the protection device 10 is shown partially attached to the helmet 130. The first component 70 of a two-part press-together connection may be seen on the first edge 30 of the protection device 10, and the second components 90 of the two-part press-together connection, illustrated by sub-parts 90*b*, 90*c*, and 90*d*, and 90*a* as connected to 70, are also shown.

Figure 4:
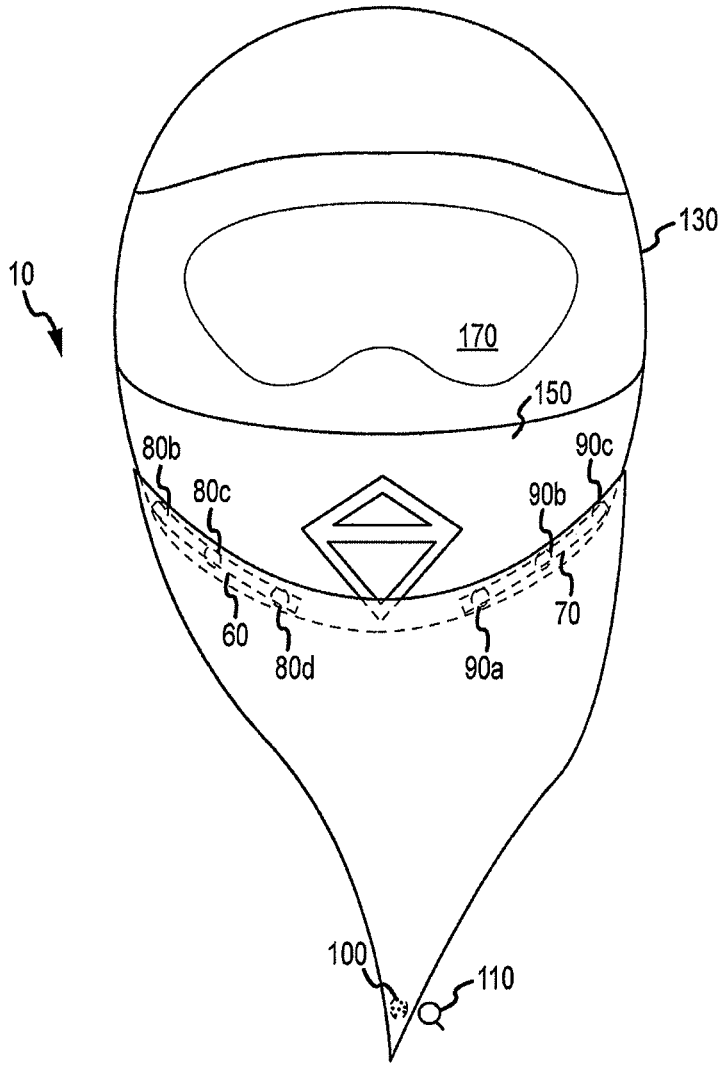
FIG. 4 provides a frontal view of a protection device as assembled together with a helmet.
Figure 7C:
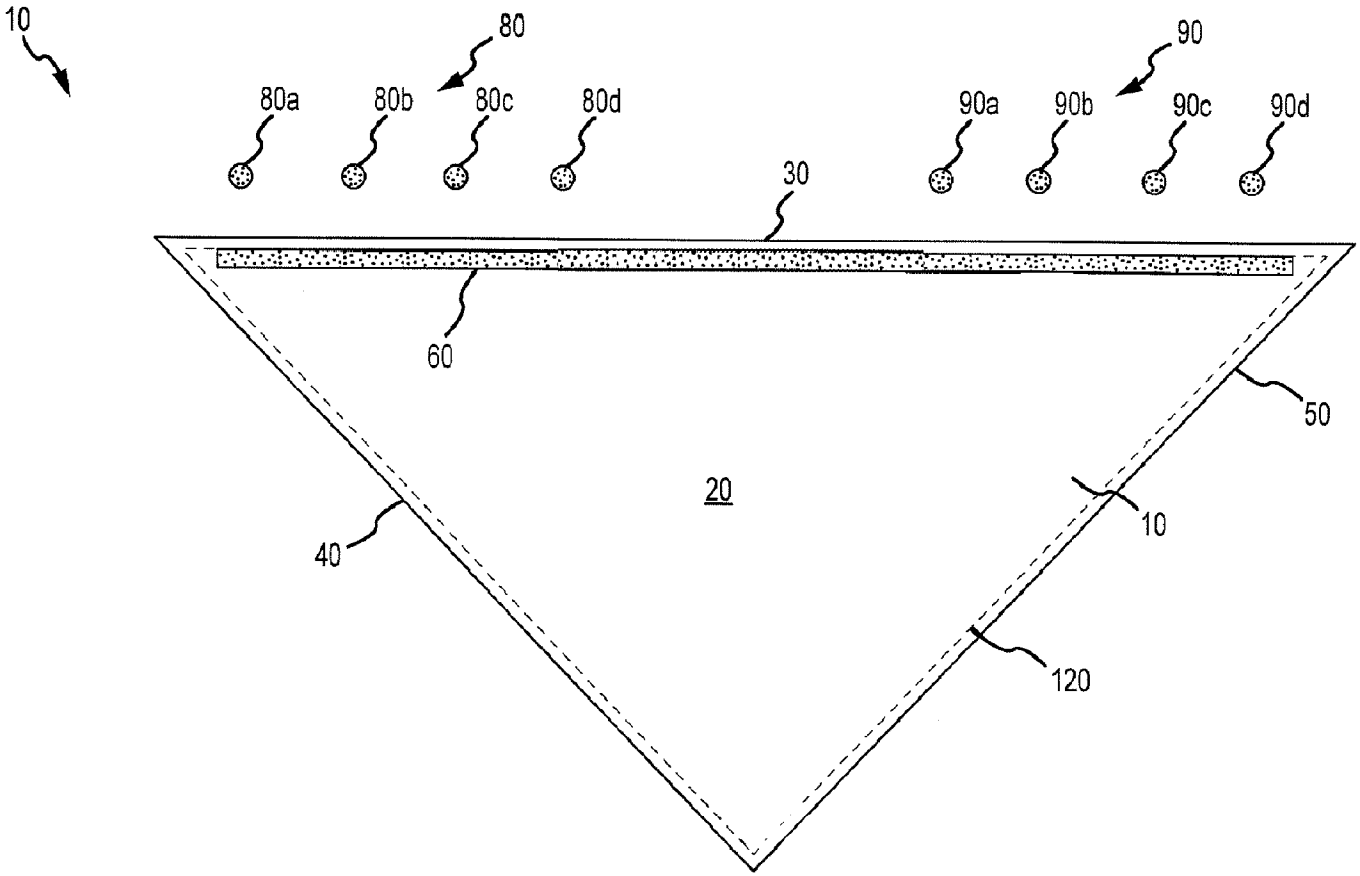

FIG. 4 depicts a frontal view of the protection device 10 coupled with a helmet 130. The protection device 10 is shown partially covering the aperture 150, but still allowing for breathing space for the wearer. Aperture 170, through which the wearer would see, is illustrated as well. Shown in dashed lines indicating placement on the helmet side of the protection device 10 are first connection component(s) 60 and 70. As noted above, the first connection component may comprise a single connection component (e.g., as illustrated by FIGS. 7A-C), two connection components (e.g., as illustrated by FIGS. 1A-D), or a plurality of connection components (e.g., corresponding to second connection components 80*a-d* and 90*a-d* as illustrated in FIGS. 1A-D, 7A-C) along the first edge of the protection device. According to embodiments, one or more first connection component(s) may be attached to the first edge of the protection device at a single point, at two points (e.g., on a first side and a second side of the first edge of the protection device), at a plurality of discrete points (e.g., similar to second connection components 80*a-d* and 90*a-d*), or at a plurality of continuous points (e.g., similar to connection components 60 and 70). According to some embodiments, the one or more first connection components may be configured to affix to both the protection device and to a helmet (e.g. as by two-sided tape). According to other embodiments, the one or more first connection components may be configured to affix to the protection device and to second connection components on a helmet. For example, second connection components 90*a*, 90*b*, 90*c* and 90*d* illustrated on helmet 130 of FIGS. 2 and 3B. As illustrated, the connection component 100 is depicted in proximity to the complementary connection component 110.

Figure 5:
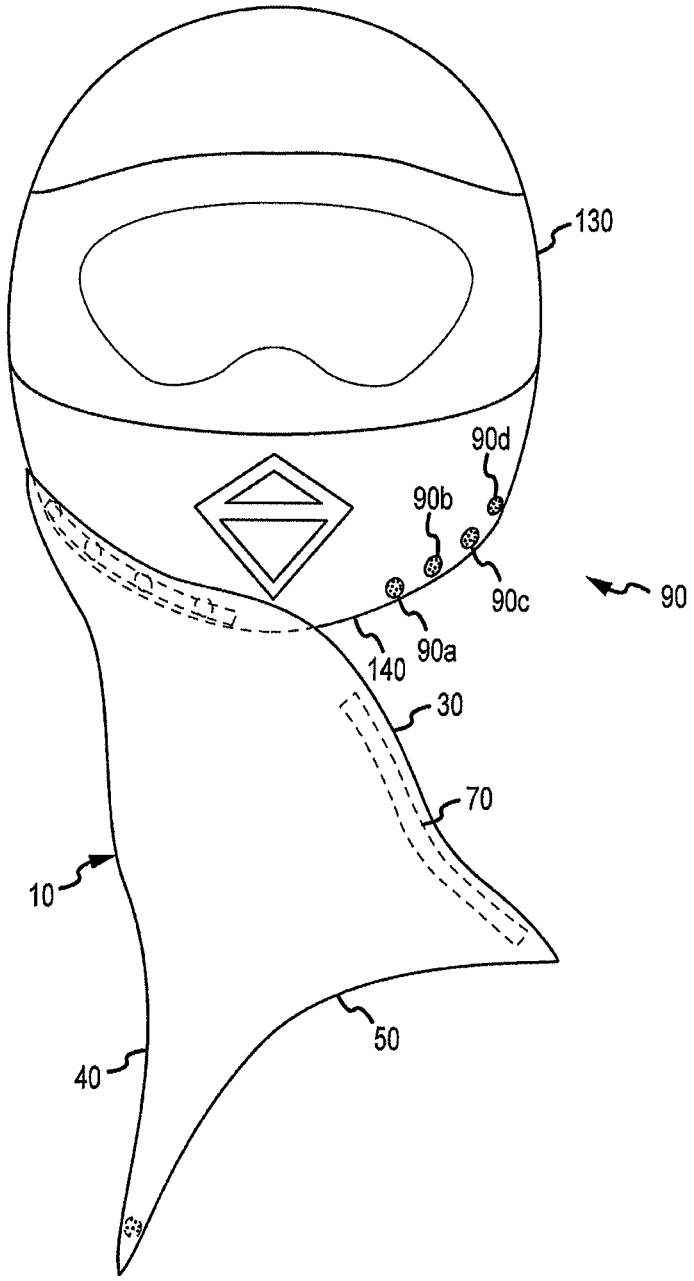
FIG. 5 provides another frontal view of a protection device as assembled together with a helmet.

FIG. 5 is another frontal view of a protection device 10 hereof partially coupled with the helmet 130, here with second connection components 90*a*, 90*b*, 90*c*, and 90*d* shown exposed and in position on lower edge 140 of the helmet 130. According to some embodiments, the second connection component may comprise a single connection component (e.g., corresponding to first connection component 60 of FIGS. 7A-C), two connection components (corresponding to first connection components 60 and 70 of FIGS. 1A-D), or a plurality of connection components (e.g., as illustrated in FIGS. 1A-D, 7A-C).

Figure 6:
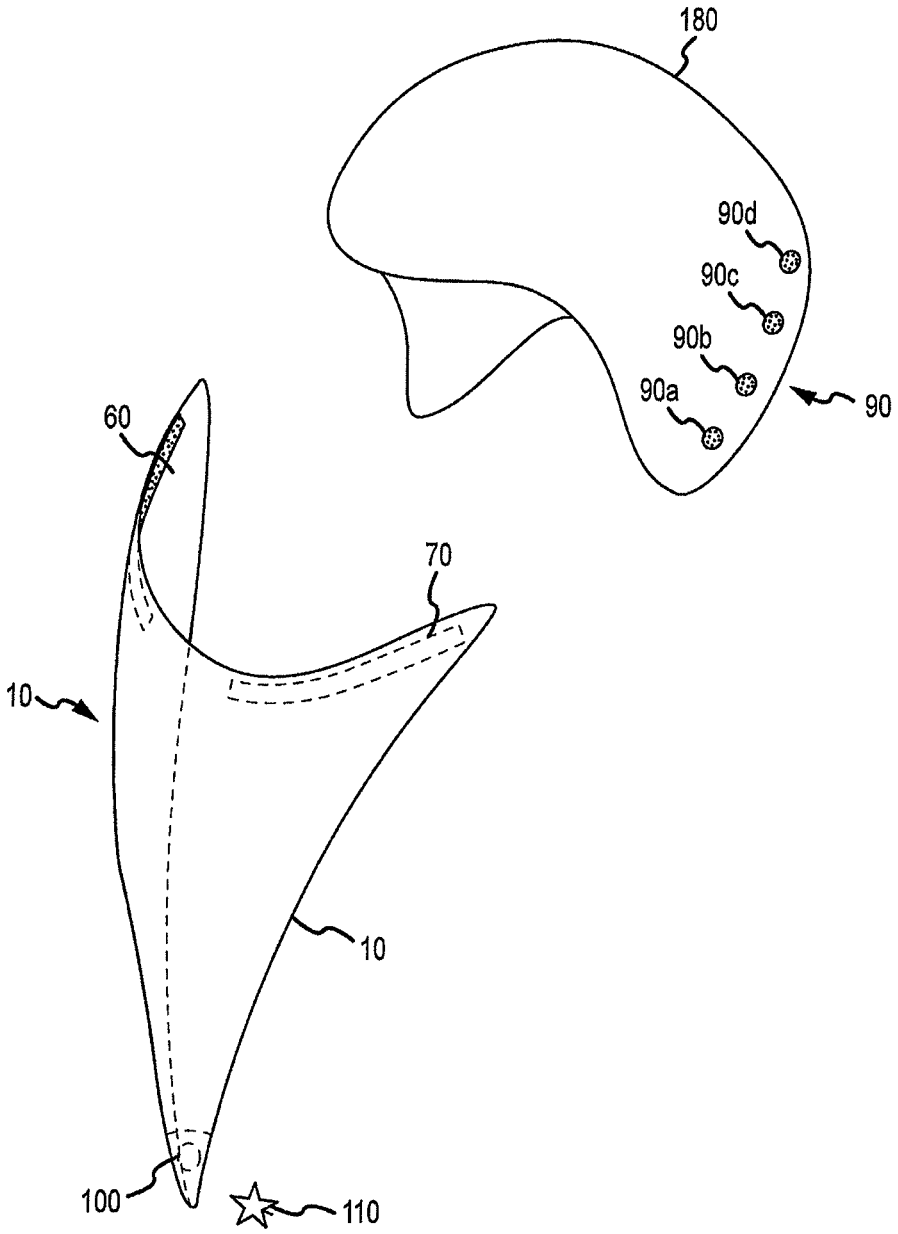
FIG. 6 provides an isometric view of a protection device hereof as attached to an open-faced helmet.

FIG. 6 illustrates a protection device 10 hereof in conjunction with an alternative open-faced helmet 180. First connection components 60 and 70 are depicted on the protection device 10, as are connection component 100 and complementary connection component 110. On the open-faced helmet 180, the orientation of the second connection component 90 may differ slightly, as illustrated in FIG. 6, but here still includes sub-parts 90*a*, 90*b*, 90*c*, and 90*d*.

Note, other helmet, headgear and hat types may also be used herewith. For example, a winter hat, stocking hat, biking helmet, motorcycle helmet, snowmobile helmet, ski helmet, open faced helmet, or the like, may form some non-limiting examples.

Historically, protection may have been provided by bandanas or like devices which have been disposed about or covering part of a wearer's face or a wearer's neck or head, in some cases to add a layer of protection against the elements. However, in adverse conditions such as snowy or icy conditions, a bandana or a neck gator or balaclava may not be sufficient. Conventional bandanas may usually be a square of material folded into a triangle that may be tied around the wearer's head (bandanas may be generally square, rectangular, folded over themselves so as to be triangular, or cut to be triangular). Usually, the material is disposed directly against the wearer's face and neck. Also, such bandanas may usually be made of cotton or like materials. In adverse conditions such as icy or snowy conditions such a conventional bandana may become packed with ice and snow which affects the performance and effectiveness of the bandana as well as the body temperature of the wearer. In the conditions of snow, ice and rain, such a bandana allows the cold water, ice and/or snow to come in contact with a wearer's face and remain there until the bandana has been removed. In conditions of extreme dirt or dust it also can pack with dirt which can make breathing difficult.

Neck gators and balaclavas are usually made of fleece or like material and can bunch around the wearer's neck. They can typically cover or be pulled up to cover the wearer's mouth and/or nose. Again, the material of the neck gator or balaclava is usually directly disposed in substantial contact against the wearer's face and neck. In icy or snowy conditions the neck gator or balaclava usually packs with ice and snow which affects the temperature of the wearer and the performance and effectiveness of the neck gator or balaclava. In addition, the balaclava, which retains heat around the head, may allow the heat to escape through the opening at eye level often causing goggles and eyewear to fog up.

Thus, when a wearer is using a bandana, which is usually made of cotton, or a neck gator or balaclava, which is usually made of fleece material, the snow and ice may be directly on the face and neck, and often frozen to the face and neck. Also, with a helmet skirt and helmet sock the snow and ice may freeze the clothing and/or zipper of a wearer and may restrict fresh air flow. Note, helmet skirts or socks which typically have been square or circular, and often defining cylindrical shapes in use around a wearer's neck would generally go or be disposed all the way or a very substantial most of the way around the helmet which allows for no ventilation or fresh air as can be provided by non-fully wrapped rectangular, or a tapered or a triangular or substantially triangular shape (reduced width) as shown and/or described in some implementations hereof. With the present development, the protection device is attached to a helmet which allows a cushion of space between the protection device and the wearer's skin so that the protection device is not directly on the face and/or neck. This provides an extra level of safety and comfort as wet snow, ice and water are not directly against the skin which help to combat frostbite and lower body temperature. When riding a snowmobile in deep snow, for example, the exposure to snow is constant. Once a snowmobile ride is over, the wearer would have an interest in removing frozen outerwear immediately. Without the present development, an outerwear zipper may be frozen solid, and the wearer may be so cold as to not be able to remove the outerwear quickly. With the present protection device, the zipper may remain unfrozen. The protection device can also be easily removed if, for example, the wearer is winded and not getting enough oxygen, or needs to wipe off or change out the protection device. The material used for the present development may be different for each type of condition. The material may be one or more of nylon, water resistant, waterproof, rip stop, mesh, resilient cotton, or other types of material, to properly accommodate the type of need.

In other environmental situations, such as dirt, wind, emissions, or bugs, the wearer has a layer of protection to protect them against the elements and the extra air space between the protection device and face for improved breathability for the wearer. A non-fully wrapped, polygonal or rectangular or triangular or substantially triangular or tapered shape/design of the protection device may allow for fresh air flow and the quick release safety connection device keeps the protection device in place and out of the wearer's eyes and face while traveling at high speeds and/or windy conditions. The material used for the present development may be different for each type of condition. The material may be one or more of nylon, water resistant, rip stop, mesh, resilient cotton, or other types of material, to properly accommodate the type of need.

Protection devices hereof may operate with a minimum of components. Assembly is intended to be simple and to require minimal skills and time. A device such as any of the protection devices as described herein may thus provide convenient and effective ways to cover alternatively all or portions of the neck and face and portions of the upper torsos of a wearer while keeping the skin of the wearer protected by attaching to a helmet rather than directly to the wearer's face and/or neck. The relative simplicity of the protection device would render it unnecessary to have any particular expertise to outfit and use the protection device. A protection device hereof may include a standard bandana and connection components which could contain all the parts needed for the wearer to assemble and use the protection device. However, more typically, special materials, sizes and the like as described herein may be used instead of a standard bandana, though the protection device may be or include a bandana or bandana-type portion. Markets for use hereof may include places where bandanas are frequently used to cover the face and neck of a wearer, such as in connection with outdoor activities that result in exposure of the wearer to the elements, i.e. snowmobiling, skiing, snowboarding, dirt biking, motorcycle riding, bicycling, ATV-ing (all-terrain vehicle), and the like.

As introduced above, a variety of alternative components may be used in the implementation of the developments hereof. Structures described herein may come in different forms. Thus, for example, the element which may constitute the body portion of the protection device may be other than as described, and may be specially tailored to be adapted to the overall protection device. Moreover, though structures have been shown and described in some detail herein, the scope and content hereof is not so limited, and instead may include alternative structures. Still furthermore, the mechanisms hereof are illustrative only as well and not limitative of the scope and content hereof. Other mechanisms may be used to the same or substantially the same effect, and thus be covered hereby.

Thus provided is a protection/bandana device which may protect the wearer from the elements by its positioning between the helmet and the upper-body outerwear of the wearer, thereby shielding the wearer's face and neck and portions of the upper torso while the triangular shape and design of the device allows for fresh air flow, reduced $CO_2$ emissions and breathability and relative freedom of movement. The quick release safety connection system allows for the stabilization of the device in windy conditions to keep it from obstructing the vision of the wearer.

Devices hereof may be made by any of a variety of methods and/or of a variety of materials. Shapes and sizes are not limited to those shown and described here either, as sizes and shapes may be selected to adapt to any of many alternative structures. Although the present developments have been described with reference to certain implementations, those skilled in the art will recognize that changes may be made in form and detail without departing from the spirit and scope of the development described herein.

What is claimed is:

1. A protection device having a body portion adapted to be one or both of connected to or disposed on a lower outside edge of a headgear, the body portion formed from a cloth material and comprising:

a first edge connectable to the headgear;

a depending tapering portion defined by a second edge and a third edge, the depending tapering portion connected to and depending downwardly from the first edge, the depending tapering portion suspended in a substantially downward extension toward a wearer's apparel; and at least one connection element on the first edge, wherein the length of the first edge is detachably connected by the at least one connection element substantially continuously along the lower outside edge of the headgear below the wearer's eyes, wherein the lower outside edge is the lowest outside edge on a front side of the headgear, wherein the first edge of the body portion extends at least partially along a first side and a second side of the lower outside edge of the headgear, and wherein the body portion does not extend completely around a back side of the headgear;

wherein the first edge, the second edge, and the third edge define at least one structural open space between the body portion and the wearer's apparel so as to allow air flow ventilation between the second edge and the wearer's apparel and between the third edge and the wearer's apparel.

2. The protection device according to claim 1, wherein the body portion is adapted to be one or both of connected to or disposed upon an item of upper body outerwear.

3. The protection device according to claim 1, wherein the at least one connection element is disposed at and relative to at least one complementary connection component on the outside lower edge of the headgear for coupling the body portion of the protection device with the headgear.

4. The protection device according to claim 3, wherein the depending tapering portion is suspended in a substantially downward extension toward the wearer's apparel as a result of gravity operating on the depending tapering portion.

5. The protection device according to claim 1, wherein a weighted element is located at an apex of the second edge and the third edge of the body portion, and wherein the weighted element is adapted to suspend the depending tapering portion in a substantially downward extension toward the wearer's apparel.

6. The protection device according to claim 1, wherein a weighted element is located along at least one edge of the body portion, and wherein the weighted element is adapted to suspend the depending tapering portion in a substantially downward extension toward the wearer's apparel.

7. The protection device according to claim 5, wherein the weighted element is adapted for connecting to a complementary connective component on the wearer's apparel, and wherein the weighted element and the complementary connective component are selected from the group consisting of: button style fasteners, magnets, snap-type fasteners, clip style fasteners, sticky-tape style fasteners, pin fasteners, and hook and loop fasteners.

8. The protection device according to claim 1, the body portion being stiffened for the purpose of keeping the body portion relatively rigid, and wherein the depending tapering portion is suspended in a substantially downward extension toward the wearer's apparel as a result of the stiffening.

9. The protection device according to claim 8, wherein a stiffening component is located along at least one edge of the body portion, and wherein the stiffening component is adapted to suspend the depending tapering portion in a substantially downward extension toward the wearer's apparel.

10. The protection device as recited in claim 1, wherein the cloth material is one or more of windproof, waterproof, water-resistant and breathable, and wherein the cloth material is adapted to suspend the depending tapering portion in a substantially downward extension toward the wearer's apparel.

11. The protection device according to claim 1, wherein the at least one connection element is a continuous connection element from a first side of the first edge to a second side of the first edge of the body portion.

12. The protection device according to claim 5, wherein the weighted element is adapted to prevent the protection device from obstructing at least one of the wearer's vision and the wearer's freedom of movement.

13. A method for using a face, neck and upper torso protection device, the protection device formed from a cloth material, the method comprising the steps of:

disposing a protection device adjacent to and covering at least a portion of the frontal face, frontal neck, and upper torso of a wearer by connecting a first edge of a body portion of the protection device to a headgear, the body portion further comprising a depending tapering portion defined by a second edge and a third edge, the depending tapering portion suspended in a substantially downward extension from the first edge toward the wearer's apparel;

detachably connecting the length of the first edge of the body portion substantially continuously along a lower outside edge of the headgear below the wearer's eyes by coupling at least one connection element on the first edge to at least one complementary connection component on the headgear, wherein the lower outside edge is the lowest outside edge on a front side of the headgear, and wherein the body portion does not extend completely around a back side of the headgear; and providing at least one structural open space defined by the first edge, the second edge, and the third edge between the body portion and the wearer's apparel so as to allow air flow ventilation between the second edge and the wearer's apparel and between the third edge and the wearer's apparel.

14. The method of claim 13, wherein a weighted element is located along at least one edge of the body portion, and wherein the weighted element is adapted to suspend the depending tapering portion in a substantially downward extension toward the wearer's apparel.

15. The method of claim 13, wherein the body portion is made of a material that is one or more of windproof, waterproof, water-resistant and breathable, and wherein the material is adapted to suspend the depending tapering portion in a substantially downward extension toward the wearer's apparel.

16. A protection system for covering the face, neck, and upper torso of an individual, the system comprising:

a headgear;

a body portion formed from a cloth material, comprising:

a first edge connectable to the headgear;

a depending tapering portion defined by a second edge and a third edge, the depending tapering portion connected to and depending downwardly from the first edge, the depending tapering portion suspended in a substantially downward extension from the first edge toward the upper torso of the individual; and at least one connection element on the first edge, wherein the length of the first edge is detachably connected by the at least one connection element substantially continuously along a lower outside edge of the headgear below the wearer's eyes, wherein the lower outside edge is the lowest outside edge on a front side of the headgear, wherein the first edge of the body portion extends at least partially along a first side and a second side of the lower outside edge of the headgear, and wherein the body portion does not extend completely around the headgear;

wherein the first edge, the second edge, and the third edge define at least one structural open space between the body portion and the upper torso of the individual so as to allow air flow ventilation between the second edge and the upper torso of the individual and between the third edge and the upper torso of the individual, and wherein the body portion is adapted to protect at least a lower portion of the individual's face, the individual's throat, and a portion of the individual's upper torso.

17. The protection system according to claim 16, wherein a stiffening component is located along at least one edge of the body portion, and wherein the stiffening component is adapted to suspend the depending tapering portion in a substantially downward extension toward the upper torso of the individual.

18. The protection system according to claim 16, wherein a weighted element is located at an apex of the second edge and the third edge of the body portion, and wherein the weighted element is adapted to suspend the depending tapering portion in a substantially downward extension toward the upper torso of the individual.

* * * * *